US005480151A

United States Patent [19]

Adams

[11] Patent Number: 5,480,151

[45] Date of Patent: Jan. 2, 1996

[54] GOLF CLUB SHAFT WITH ALIGNMENT SYSTEM

[76] Inventor: Byron H. Adams, 5915 Bent Creek Trail, Dallas, Tex. 75252

[21] Appl. No.: 336,664

[22] Filed: Nov. 4, 1994

[51] Int. Cl.[6] ..... A63B 53/00

[52] U.S. Cl. ..... 273/163 A; 273/81 B

[58] Field of Search ..... 273/163 R, 163 A, 273/164.1, 81 B, 81.3, 81.6, 75, 73 J, 187.4, 187.5, 187.6; D8/DIG. 6; D21/219, 222

[56] References Cited

U.S. PATENT DOCUMENTS

| | | | |
|---|---|---|---|
| D. 336,322 | 6/1993 | Poincenot et al. | D21/222 |
| 1,603,850 | 10/1926 | Keating | 73/163 A |
| 1,917,236 | 7/1933 | Bloomstrand | 273/75 |
| 3,462,155 | 8/1969 | Pelz | 273/81.3 |
| 3,549,360 | 12/1970 | Pelz | 273/164.1 |
| 4,317,568 | 3/1982 | Green | 273/163 A |
| 4,919,420 | 4/1990 | Sato | 273/81 B |
| 5,158,297 | 10/1992 | Johnson | 273/163 A |
| 5,348,303 | 9/1994 | Swissheim | 273/187.5 |

*Primary Examiner*—Vincent Millin
*Assistant Examiner*—Steven B. Wong
*Attorney, Agent, or Firm*—Aquilino & Welsh

[57] ABSTRACT

A golf club having a grip, shaft and club head including an alignment system along the length of the shaft in registration with the club head. The alignment system includes a plurality of alignment marks having an edge surface in registration each with corresponding edge surface of the others and located on a top center position of the shaft when the club head is flat on a support surface and positioned perpendicular to an intended target line. In use, a golfer may manually manipulate the shaft until the edges of the alignment marks are on the top of the shaft coincident with the top center position of the shaft as viewed by the golfer to insure the club head is oriented perpendicular to the target line.

1 Claim, 1 Drawing Sheet

GOLF CLUB SHAFT WITH ALIGNMENT SYSTEM

BACKGROUND AND SUMMARY OF THE INVENTION

The present invention relates to golf clubs that are more particular to a golf club shaft having an alignment system to enable a golfer to precisely align the club prior to the execution of a golf shot.

In playing the game of golf, it is important to have the golf club aligned precisely toward the intended target when executing a golf shot. Proper alignment of the club enables a golfer to coordinate his hands, arms, feet and body, thereby ensuring that a well executed golf swing will send a golf ball toward the intended target. Misalignment causes many errors which must be compensated for during the swing, with varying degrees of success, depending upon the athletic capabilities of a particular player. To maximize these abilities, proper alignment has been one of the basic fundamentals taught and used by proficient teachers and players.

Many golf clubs have alignment marks and alignment systems on the club itself. It is well known to provide alignment marks on the grip of a golf club to ensure that the hands are placed in the proper position and also to aid the golfer in placing the club on the ground in the proper alignment position. It is also well known to provide alignment marks and systems on the club head itself. For example, putters have been provided with alignment lines and/or dots. Similarly, wood type golf club heads have been provided with alignment arrows and other lines which aid a player in the proper placing and aiming of the club to the target prior to the execution of a shot. Iron type golf clubs have been provided with alignment marks, either on the top ridge or on the ball striking face to aid a player in properly aligning the club toward the intended target line.

Many prior art patents are directed to various alignment indicia which serve to aid a golfer to precisely and properly align a golf club to aid the golfer in the execution of a golf stroke. A particular patent of interest is U.S. Pat. No. 5,158,297 to Johnson relating to golf clubs with integral alignment indicia. The patent illustrates a golf club having a longitudinal marking indicia on the surface of the shaft and extending along one of the sides of the shaft in the form of a series of lines that are parallel to the edge of the shaft which allow a golfer to discern rotational movement of the shaft within a range of 1°–15° from a predetermined position. The lines are formed on either or both sides of the lateral external surfaces of the shaft relative to a top dead center surface position and they extend along the length of the shaft for a distance sufficient to allow a golfer to view the marking means and determine when rotational movement is present.

The present invention relates to a golf club shaft having an alignment system to aid a player in properly aligning the club. Marks on the shaft forming the alignment system are unobstructed and easily seen, whereas other alignment systems, for example, used on the grip and on the club head, may be obscured by the player's hands and by the golf ball, grass or other ground conditions which the golfer may encounter during the playing of a golf shot. Except for infrequent "trouble" shots, the shaft is always available for easy visual reference, unencumbered by other structures which could obscure the alignment indicia. The golf club of the present invention uses alignment indicia spaced along the length of the shaft relative to the top center position of the shaft.

Preferably the indicia is a series of marks in the shape of half circles, or letter C's, which are positioned along the shaft so that an upper terminal end of each alignment mark will be in a precise 12 o'clock registration along the top center position of the shaft when the golf club head is precisely positioned to the target line. Preferably, the alignment marks would extend 180° of the total 360° circumference around the shaft. With this arrangement, a player looking down the shaft when aligning the marks would know the club head is properly aligned when exactly half of the visible portion of the shaft included the alignment marks with the ends of the marks terminating at the exact top center position of the shaft as it is viewed by the golfer. With the shaft in this position, the golfer is assured that the club is positioned at the target line.

It will be appreciated that the marks may be placed anywhere along the length of the shaft, although preferably they would be positioned adjacent to the club head hosel for easy viewing.

Among the objects of the present invention are an alignment system on the shaft of a golf club to enable a player to precisely align the golf club in a direction toward the intended target.

Another object of the present invention is to provide an alignment indicia on a golf shaft, unobstructed by the player or the playing conditions, to enable a player to easily view the alignment indicia for precise registration of the club prior to the execution of the shot.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Since golf club heads are not symmetrical, it is difficult to align the club perpendicular to a desired target line. With the present invention, alignment indicia are provided on the shaft which are in precise registration with the club head. Thus, in order to practice the present invention it only becomes necessary to learn the position of the indicia when the club head is precisely aligned perpendicular to the intended line of flight. Once the indicia position is learned it becomes a simple matter for the golfer to manipulate the golf club until the known position is achieved thereby insuring that the club head is properly aligned. Preferably the alignment indicia creates a sighting image on the top center position of the shaft when the club is properly aligned which is visible to the golfer. If the sighting image is offset from the top center position of the shaft, it will be apparent that the club head is not aligned and that it is open or closed, depending upon which side of the centerline the sighting image is viewed.

Figure 1:
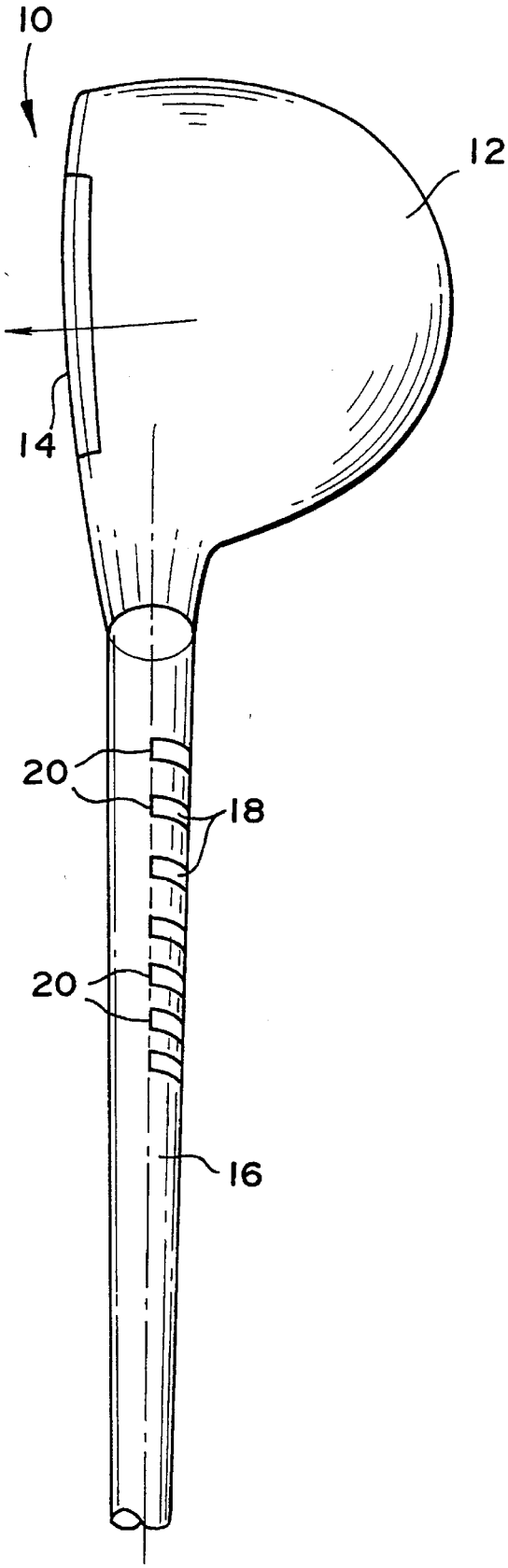
FIG. 1 is a top view of a golf club in accordance with the present invention with the club head precisely aligned perpendicular to an intended target.
Figure 2:
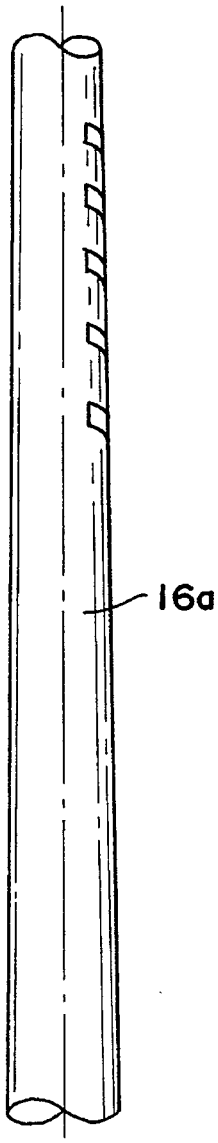
FIG. 2 is a partial view of a shaft having alignment indicia indicating that the golf club is aligned to the right of the target.
Figure 3:
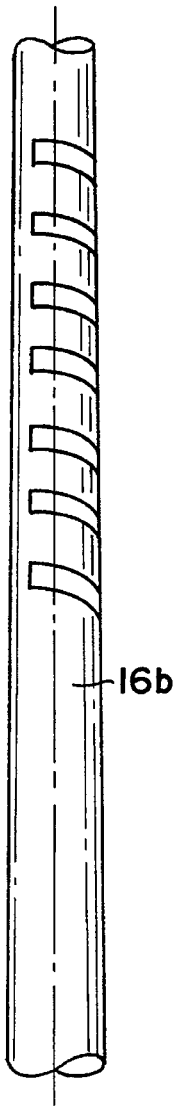
FIG. 3 is a detail of a shaft having alignment indicia which show the golf club head aligned to the left of the target.

Referring to the drawings, a first embodiment of the invention is shown in FIGS. 1 to 3. A golf club 10, made in accordance with the present invention, is formed with a club head 12 having a ball striking face 14 and a shaft 16. A series of alignment indicia 18 are positioned on the shaft 16 so that ends 20 of the indicia are aligned precisely on the top center position of the shaft when the club head end 12 and ball striking face 14 are precisely aligned perpendicular to the target line. Preferably, the indicia are a series of semi-circular C-shaped marks which extend approximately 180° around the total 360° periphery of the exterior of the shaft.

With the golf club head 12 precisely aligned, the ends 20 of the indicia 18 appear at the top center position of the shaft 16 whereby the indicia 18 cover precisely half of the shaft 16 as it is viewed by the golfer. When the indicia marks 18 are aligned in this manner, the golfer is assured that the club head 12 and ball striking face 14 are precisely aligned to the target.

Referring to FIG. 2, a shaft **16*a* includes alignment indicia 18*a* having ends 20*a* which are positioned to the right of the top center position of the shaft 16*a* indicating that the club face that the ball striking face 14 of the club head 12 is rotated open away from the target line. Similarly, FIG. 3 illustrates a golf club shaft 16*b* having alignment indicia 18*b* with ends 20*b*** which are positioned to the left of the top center position as viewed by the golfer, indicating to the golfer that the club head and ball striking face is in a closed position. It will be appreciated that the position of the club head may be adjusted by merely rotating the shaft until the edges of the indicia are coincident with the top center position of the shaft.

It will be appreciated that the alignment indicia as shown in the present invention preferably are equally spaced along the longitudinal axis of the shaft 16. However, the indicia marks may be randomly positioned in keeping with the spirit and scope of the present invention. Furthermore, the marks do not necessarily need to be adjacent the club head but may be moved further up the shaft and used without departing from the principles of the present invention.

With the alignment system of the present invention, a golfer is not only able to precisely align the club head perpendicular to the target line, but may also align the club head to either side, in an open or closed position, by simply rotating the shaft so that the sighting line appears to either side of the centerline of the shaft. This enables a player to hit shots that will move from right to left or left to right, depending upon the requirements of a specific shot that has to be made.

Overall, the alignment system of the present invention permits a golfer to precisely align the club head in a consistent repeating manner without having to look at the curved surfaces of the club head, a procedure which requires the golfer to make mental adjustments to determine the orientation of the club head to the target line. The alignment system of the present invention ensures that the club face will always be perpendicular to the target line when the sighting line is on top of the shaft coincident with the centerline as seen by the golfer.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A golf club including a club head, grip, shaft and alignment system to aid a golfer in aligning the club toward an intended target line comprising:

alignment indicia in the form of a series of identical, in-line, alignment marks on the shaft, adjacent the head, forming a sighting image along a length of the shaft;

said alignment indicia being equally spaced from each other in the form of C-shaped marks extending approximately 180° around the periphery of the shaft and including ends which are in registration with said club head and located at a precise top center position of said shaft when said club head is precisely aligned perpendicular to an intended target line;

whereby positioning the sighting image at the top center position of said shaft locates the club head to the intended target line.

* * * * *